US010676973B2

(12) United States Patent
Jean

(10) Patent No.: US 10,676,973 B2
(45) Date of Patent: Jun. 9, 2020

(54) LATCH HOOK-TYPE POSITIONING DEVICE

(71) Applicant: KHAN'S ENTERPRISE CO., LTD., Taoyuan (TW)

(72) Inventor: Wen-Fong Jean, Taoyuan (TW)

(73) Assignee: Khan's Enterprise Co., Ltd., Taoyuan (TW)

( * ) Notice: Subject to any disclaimer, the term of this patent is extended or adjusted under 35 U.S.C. 154(b) by 416 days.

(21) Appl. No.: 15/485,304

(22) Filed: Apr. 12, 2017

(65) Prior Publication Data

US 2018/0298655 A1 Oct. 18, 2018

(51) Int. Cl.
*E05C 19/14* (2006.01)
*E05B 63/14* (2006.01)

(52) U.S. Cl.
CPC ..... *E05C 19/14* (2013.01); *E05B 63/143* (2013.01)

(58) Field of Classification Search
CPC ..... E05C 19/14; E05C 19/145; E05C 19/12; E05C 3/045; E05C 3/40; E05B 63/143; E05B 63/146
USPC ..... 292/64
See application file for complete search history.

(56) References Cited

U.S. PATENT DOCUMENTS 2,477,472 A * 7/1949 Wright ..... E05C 19/145 292/113
2,784,994 A * 3/1957 Hopkins ..... E05C 19/14 292/247
2005/0236862 A1* 10/2005 Martone ..... B60N 2/01583 296/65.03
2006/0042897 A1* 3/2006 Sanderson ..... A45C 13/1084 190/120
2008/0129056 A1* 6/2008 Hernandez ..... E05B 63/143 292/98
2008/0307835 A1* 12/2008 Grenier ..... A45C 13/1084 70/69

* cited by examiner

*Primary Examiner* — Nathan Cumar
(74) *Attorney, Agent, or Firm* — Alan D. Kamrath; Karin L. Williams; Mayer & Williams PC

(57) ABSTRACT

A latch hook-type positioning device includes a base fixed to a first part of an article. A positioning member is fixed to a second part of the article and includes a hook portion. An end of a pivotal member is pivotably connected to the base. A latch hook unit includes a body, a positioning pin, and a latch bar releasably engaged with the hook portion. The body includes a bottom side having a receiving space and at least one sliding groove at an end of the receiving space. The other end of the pivotal member is pivotably connected to the other end of the receiving space of the body. At least one elastic member is attached between the positioning pin and the latch bar. The latch bar is slideable in the at least one sliding groove to stretch the at least one elastic member, providing a larger tolerance for installation.

2 Claims, 9 Drawing Sheets

LATCH HOOK-TYPE POSITIONING DEVICE

BACKGROUND OF THE INVENTION

The present invention relates to a latch hook-type positioning device and, more particularly, to a latch hook-type positioning device using an elastic force to fix a door, window, or cabinet to permit easy use and installation.

A door, window, or cabinet generally includes two main parts (such as door plates, door frames, window frames) movable toward or away from each other. Doors, windows, cabinets of this type generally include a hook device to retain the closed position. A common hook device includes a handle mounted on one of the two main parts for manual operation and a hook mounted on the other of the two main parts for engaging with the handle to prevent opening. Thus, precise installation pursuant to a specific spacing between the two main parts in the closed position is required during installation of the handle and the hook. However, the handle cannot engage with the hook if the spacing is either too large or too small. Furthermore, the hook device of this type wear after a period of time of use, failing to tightly close the door or window.

Thus, a need exists for a novel latch hook device that permits easy installation while having a larger tolerance.

BRIEF SUMMARY OF THE INVENTION

The primary objective of the present invention is to use the elasticity of an elastic member of a latch hook unit to permit elastic displacement of a latch bar, such that a larger tolerance is provided during installation, thereby permitting easy installation by the user while creating a stable engagement between the latch bar and a positioning member by the elastic displacement capability.

To fulfill the above objective, the present invention provides a latch hook-type positioning device including a base unit having a base and a pivotal member. The pivotal member includes a first end pivotably connected to the base and a second end. The base is adapted to be fixed to a first part of an article. A latch hook unit includes a body, a positioning pin, a latch bar, and at least one elastic member. The body includes a bottom side having a receiving space. The body further includes at least one sliding groove at an end of the receiving space. The second end of the pivotal member is pivotably connected to the other end of the receiving space of the body. The positioning pin is fixed between two sidewalls of the receiving space. The latch bar is slideably received in the at least one sliding groove. The at least one elastic member includes two ends respectively attached to the positioning pin and the latch bar. A positioning member includes a positioning portion and a hook portion extending from a side of the positioning portion. The positioning member is adapted to be fixed to a second part of the article. The first part of the article is pivotably connected to the second part of the article and is movable between a closed position and an open position when the latch bar of the latch hook unit is disengaged from the hook portion of the positioning member.

When the first part of the article is in the closed position, the pivotal member is pivotable relative to the base, and the body of the latch hook unit and is pivotable relative to the pivotal member, such that the latch bar of the latch hook unit is releasably engageable with the hook portion of the positioning member.

When the latch bar of the latch hook unit engages with the hook portion of the positioning member, the body of the latch hook unit and the pivotal member are further pivotable relative to the base, causing further pivotal movement of the second end of the pivotal member toward the first part of the article. The second end of the pivotal member is positionable in a retaining position in which in which the second end of the pivotal member is located on a side of the base remote to the positioning member. The first part of the article is securely retained in the closed position when the second end of the pivotal member is in the retaining position. The latch bar of the latch hook unit slides in the at least one sliding groove to stretch the at least one elastic member during further pivotal movement of the second end of the pivotal member toward the first part of the article.

In an example, the at least one sliding groove includes two sliding grooves respectively defined in the two lateral walls at the end of the receiving space, and with the latch bar including two ends respectively and slideably received in the two sliding grooves.

In an example, the at least one elastic member includes a plurality of elastic members attached between the positioning pin and the latch bar.

In an example, the latch hook unit further includes a cushioning pad mounted to a bottom wall of the receiving space of the body. The cushioning pad abuts against the base when the second end of the pivotal member is in the retaining position. The cushioning pad does not abut against the base when the second end of the pivotal member is not in the retaining position.

The present invention will become clearer in light of the following detailed description of illustrative embodiments of this invention described in connection with the drawings.

DETAILED DESCRIPTION OF THE INVENTION

Figure 1:
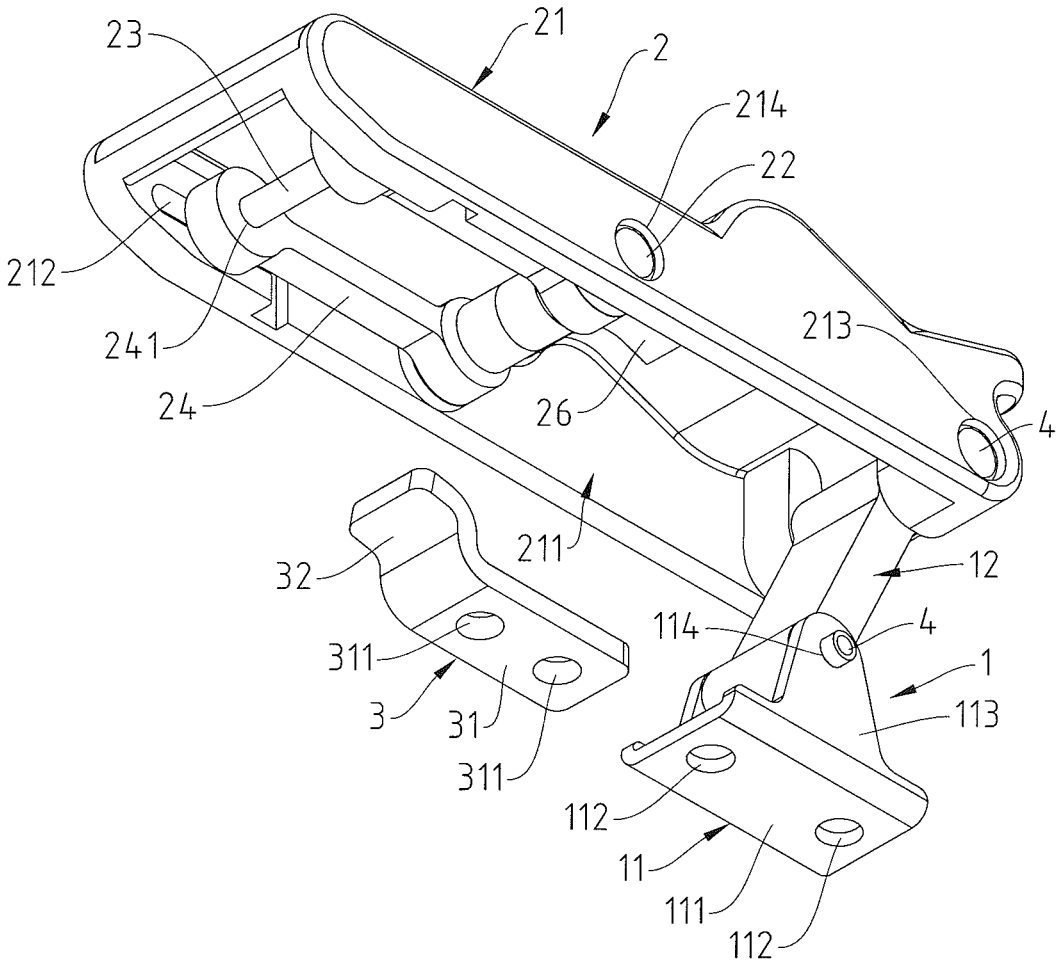
FIG. 1 is a perspective view of a latch hook-type positioning device according to the present invention.
Figure 2:
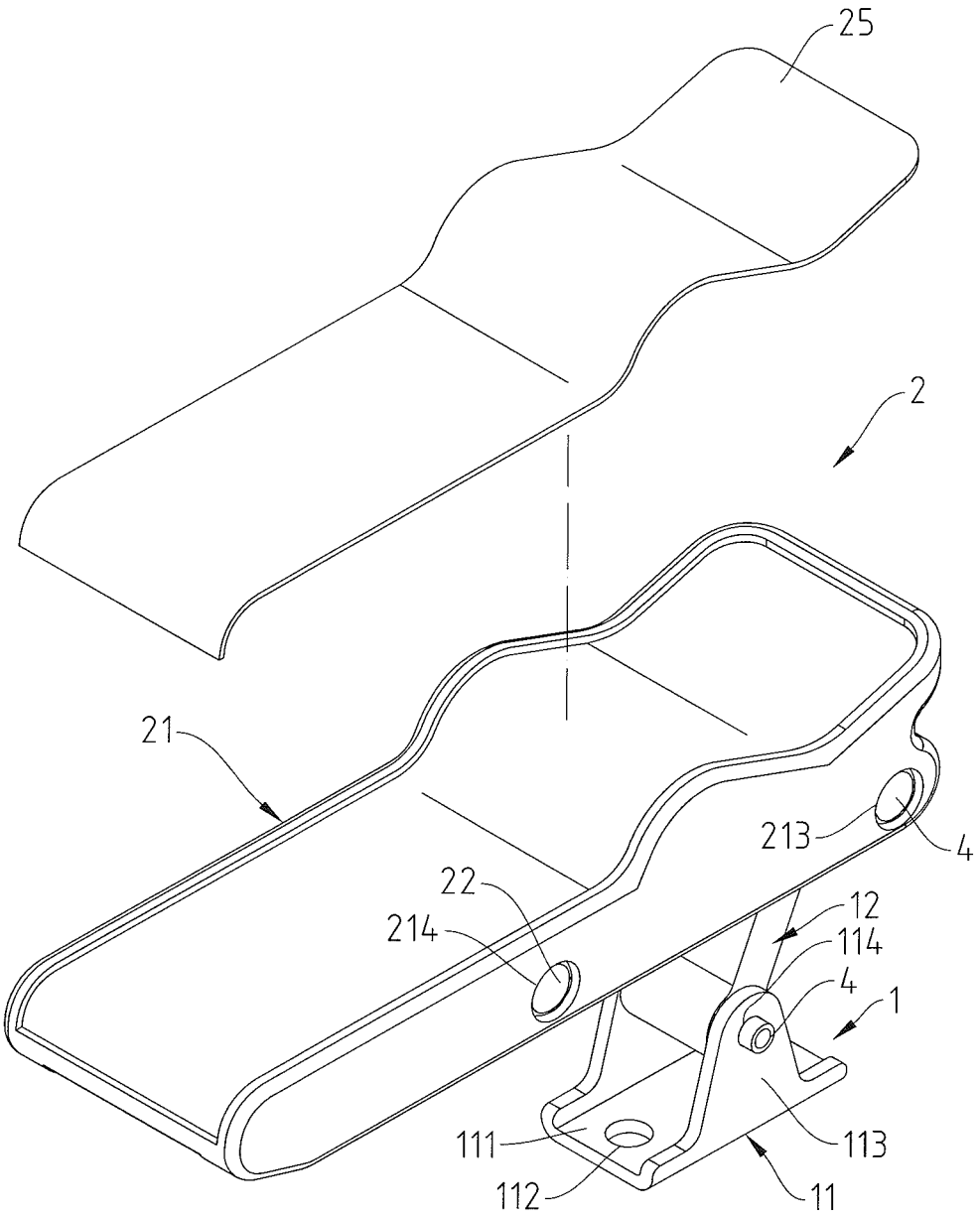
FIG. 2 is another perspective view of the latch hook-type positioning device of FIG. 1.
Figure 3:
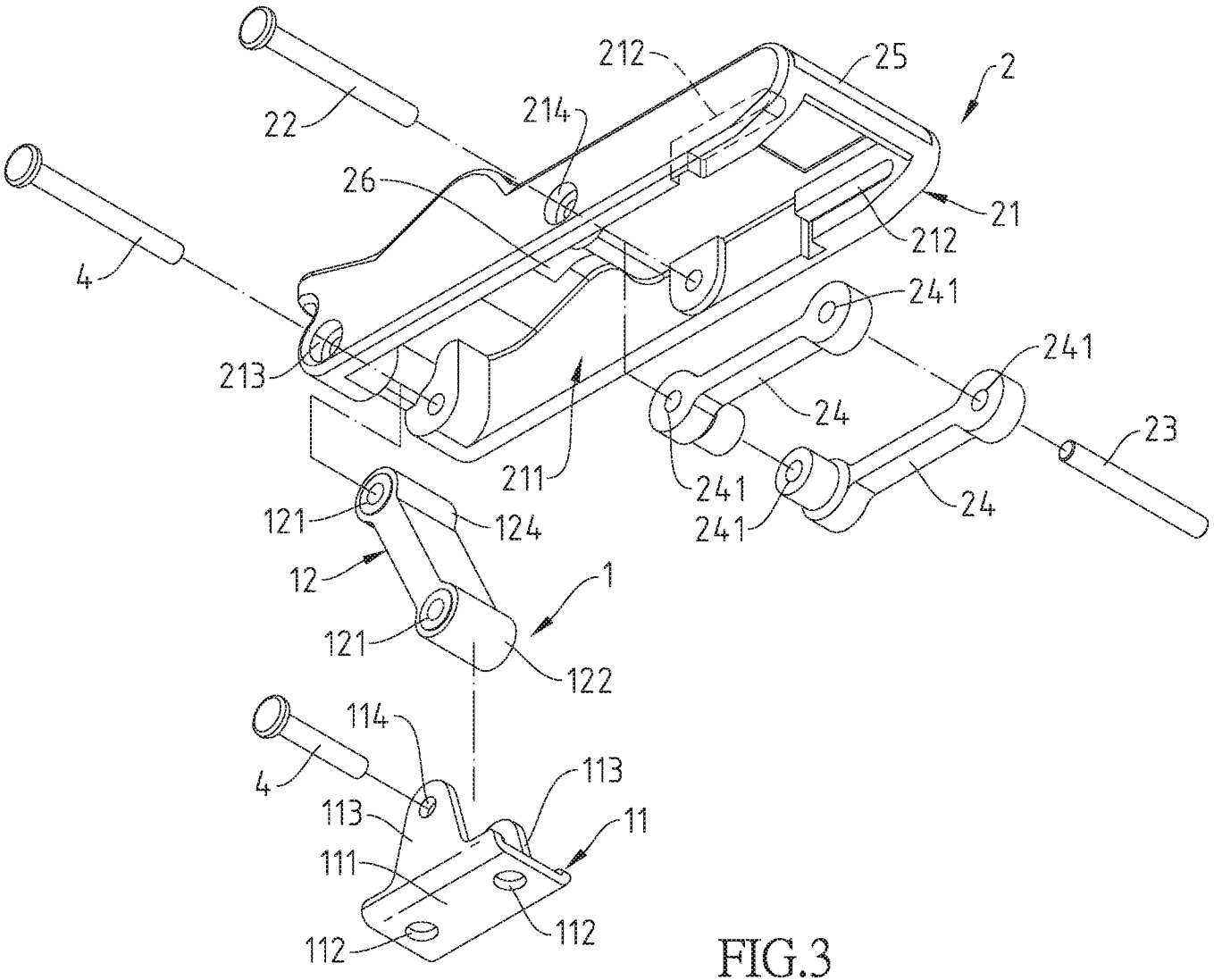
FIG. 3 is an exploded perspective view of the latch hook-type positioning device of FIG. 2.

With reference to FIGS. 1-3, a latch hook-type positioning device according to the present invention includes a base unit 1, a latch hook unit 2, and a positioning member 3. The positioning device is adapted to be mounted to an article having a first part and a second part. In an embodiment shown in FIG. 4, the article is a cabinet 5 including a door 51 (the first part) and a cabinet body (the second part).

The base unit 1 includes a base 11 and a pivotal member 12. The base 11 includes a seat 111 having fixing holes 112. An arm 113 extends upright from each of two sides of the seat 111. The arms 113 have aligned positioning holes 114. A pivot 4 extends through the positioning holes 114. The pivotal member 12 includes first and second ends 122 and 124. Each of the first and second ends 122 and 124 of the pivotal member 12 has a pivotal hole 121. The pivot 4 also extends through the pivotal hole 121 in the first end 122 of the pivotal member 12, permitting pivotal movement of the pivotal member 12 relative to the base 11. The base 11 is adapted to be fixed to the first part of the article (the door 51 of the cabinet 5 in this embodiment).

In this embodiment, the latch hook unit 2 includes a body 21, a positioning pin 22, a latch bar 23, at least one elastic member 24, an escutcheon 25, and a cushioning pad 26. The body 21 includes a bottom side having a receiving space 211. The body 21 further includes at least one sliding groove 212 at an end of the receiving space 211. In this embodiment, the body 21 includes two sliding grooves 212 respectively defined in two lateral walls at an end of the receiving space 211. The latch bar 23 includes two ends respectively and slideably received in the two sliding grooves 212.

The body 21 further includes a positioning hole 213 at the other end of the receiving space 211. Another pivot 4 extends through the positioning hole 213 and the pivotal hole 121 of the second end 124 of the pivotal member 12. Thus, the second end 124 of the pivotal member 12 is pivotably connected to the other end of the receiving space 211 of the body 21.

Fixing holes 214 are defined in intermediate portions of the two lateral walls of the receiving space 211 of the body 21. The positioning pin 22 is fixed in the fixing holes 214 of the two lateral walls of the receiving space 211. In this embodiment, the latch hook unit 2 includes a plurality of elastic members 24 attached between the positioning pin 22 and the latch bar 23. Each elastic member 24 is made of thermoplastic material. Each elastic member 24 includes two connecting holes 241 respectively defined in two ends thereof. The positioning pin 22 extends through one of the two connecting holes 241 in each elastic member 24. The latch bar 23 extends through the other connecting hole 241 in each elastic member 24. The escutcheon 25 is mounted to a surface of the body 21. The cushioning pad 26 is mounted to a bottom wall of the receiving space 211 of the body 21.

The positioning member 3 includes a positioning portion 31 and a hook portion 32 extending from a side of the positioning portion 31. The positioning portion 31 has fixing holes 311. The positioning member 3 is adapted to be fixed to the second part of the article (the cabinet body of the cabinet 5 in this embodiment). The door 51 is movable between a closed position and an open position when the latch bar 23 of the latch hook unit 2 is disengaged from the hook portion 32 of the positioning member 3.

Figure 4:
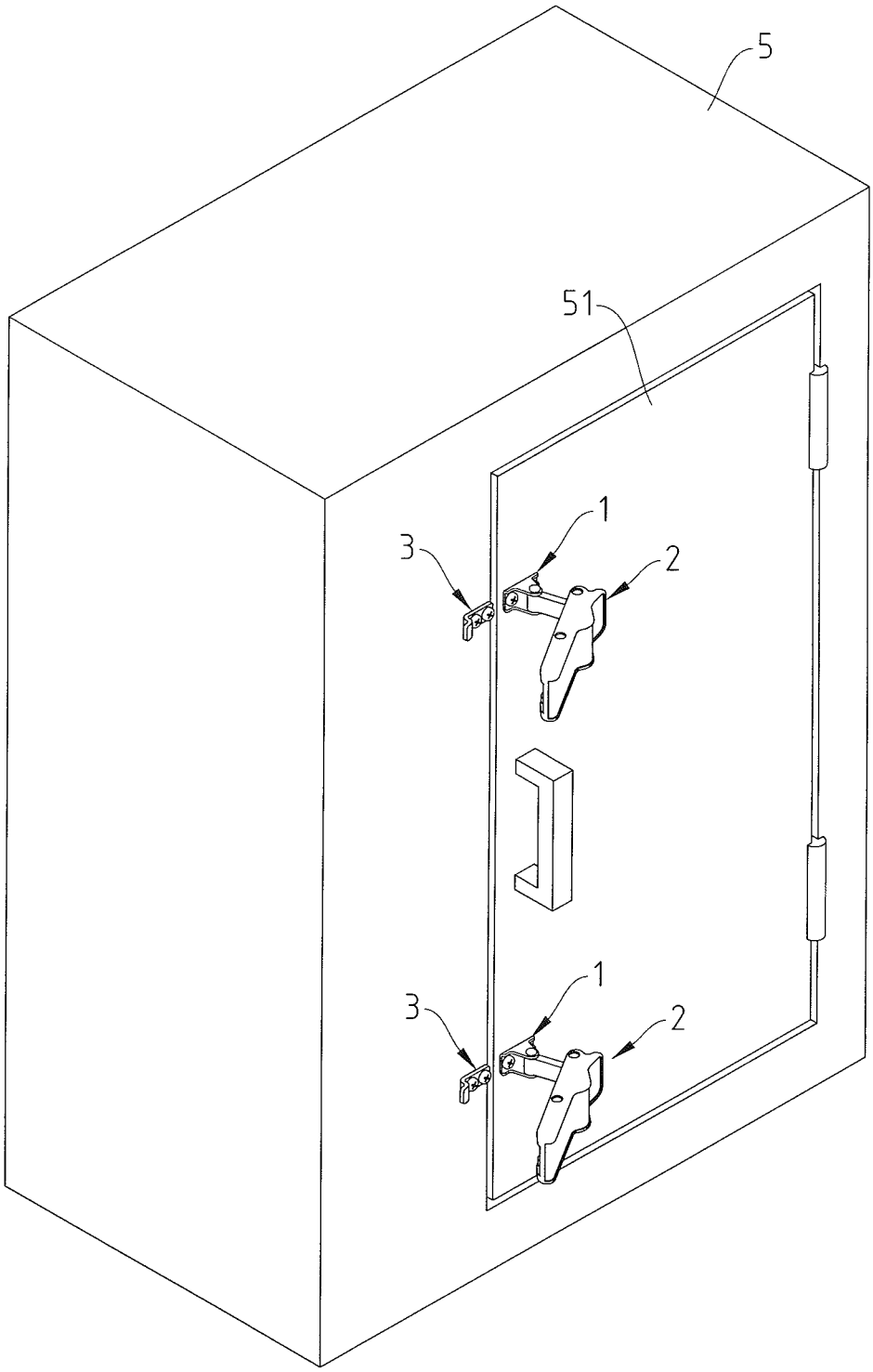
FIG. 4 is a perspective view illustrating use of two latch hook-type positioning devices on a cabinet.
Figure 5:
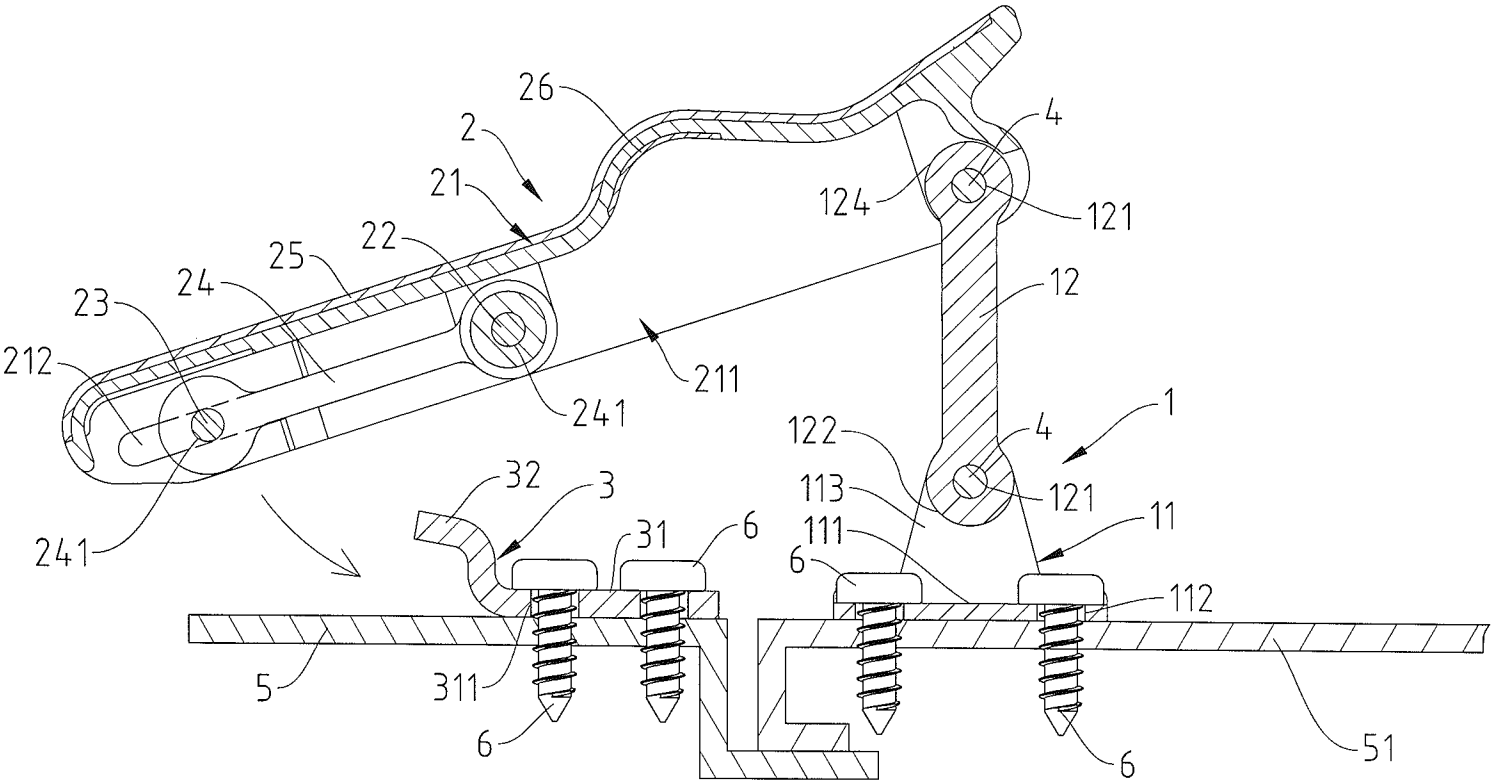
FIG. 5 is a cross sectional view illustrating the latch hook-type positioning device to be moved to a retaining position.

With reference to FIGS. 4 and 5, two positioning devices are utilized on the cabinet 5. Installation and operation of only one of the two positioning devices will be set forth. Fasteners 6 extend through the fixing holes 112 to fix the base 11 to the door 51 of the cabinet 5. Other fasteners 6 extend through the fixing holes 311 of the positioning portion 31 to fix the positioning member 3 to the cabinet body of the cabinet 5 at a position adjacent to an edge of the door 51 in the closed position.

Figure 6:
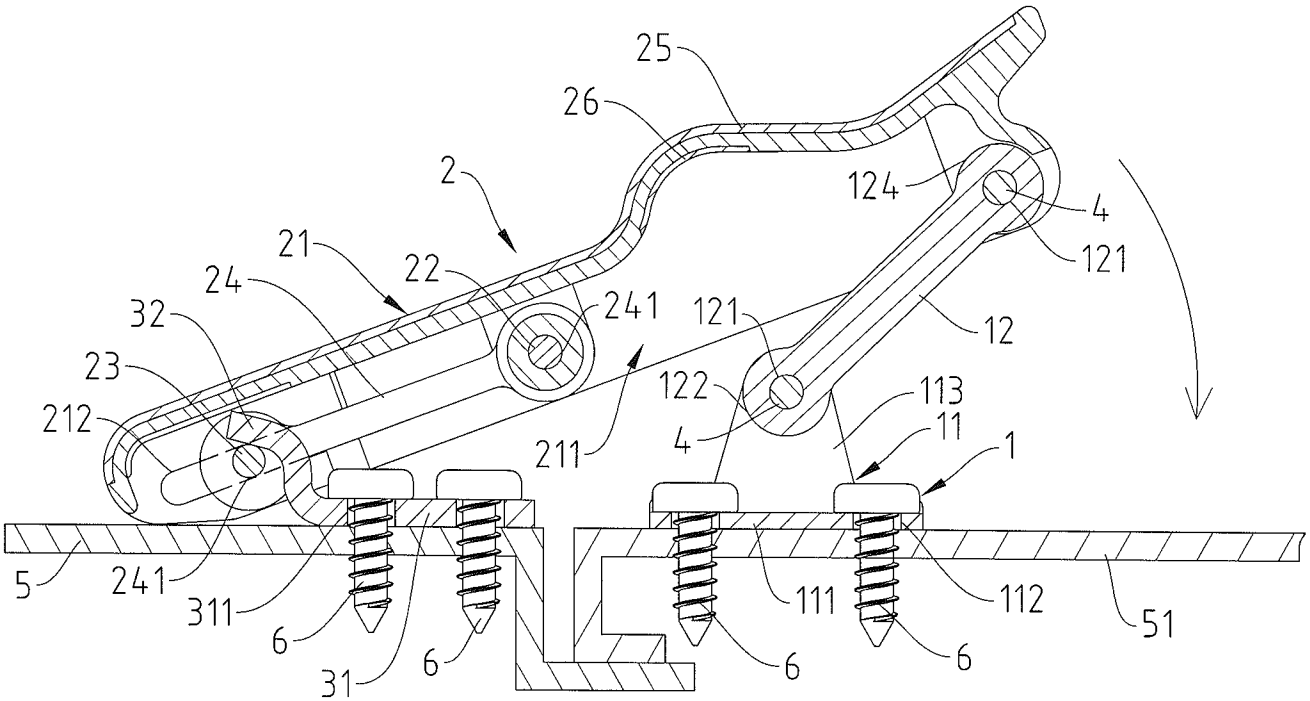
FIG. 6 is a view similar to FIG. 5, illustrating further movement of the positioning device to the retaining position.

With reference to FIG. 5, when it is desired to retain the door 51 in the closed position to prevent opening of the door 51, the body 21 and the pivotal member 12 are pivoted to a position in which the pivotal member 12 is substantially perpendicular to the base 11. Then, the latch bar 23 is moved to engage with the hook portion 32, as indicated by the arrow shown in FIG. 5. FIG. 6 shows releasable engagement between the latch bar 23 and the hook portion 32.

Figure 7:
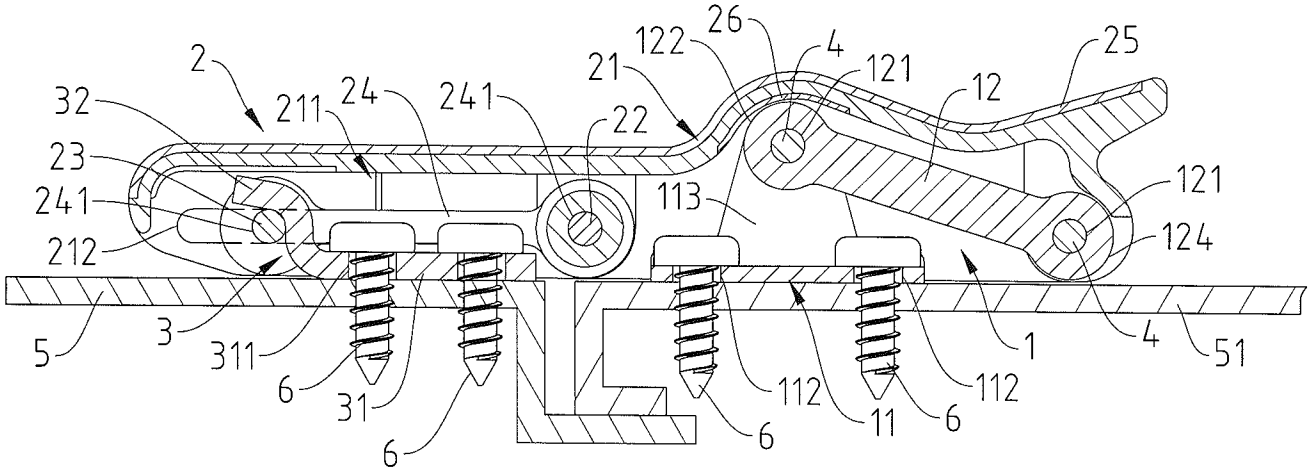
FIG. 7 is a view similar to FIG. 6, illustrating the positioning device in the retaining position.
Figure 8:
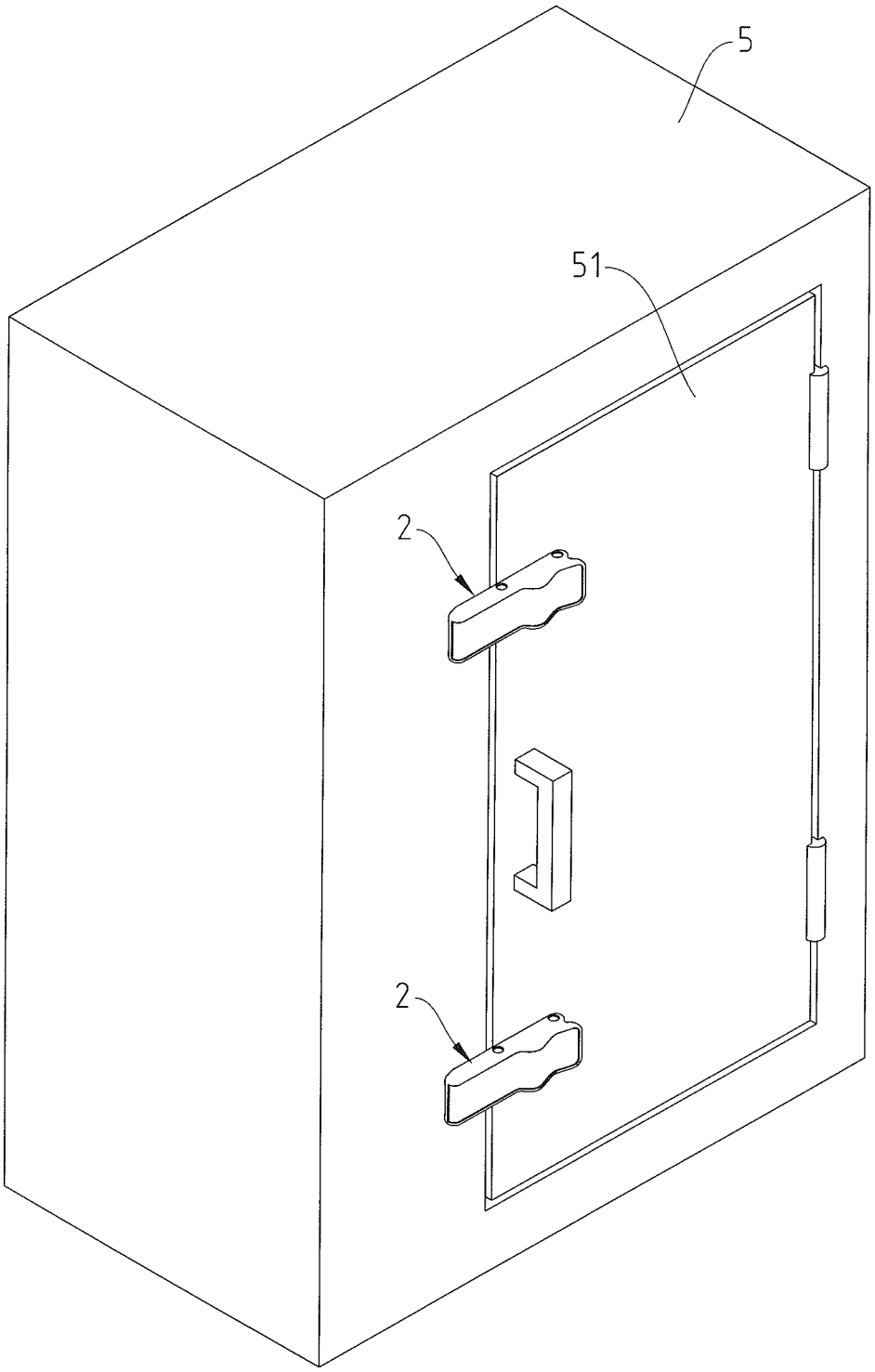
FIG. 8 is a perspective view of the cabinet of FIG. 4, with a door of the cabinet retained in a closed position.

When the latch bar 23 of the latch hook unit 2 engages with the hook portion 32 of the positioning member 3, the body 21 of the latch hook unit 2 and the pivotal member 12 are further pivotable relative to the base 11, causing further pivotal movement of the second end 124 of the pivotal member 12 toward the door 51, as indicated by the arrow shown in FIG. 6. With reference to FIG. 7, the second end 124 of the pivotal member 12 can be positioned in a retaining position in which the second end 124 of the pivotal member 12 is located on a side of the base 11 remote to the positioning member 3 and is adjacent to the door 51. The door 51 is securely retained in the closed position when the second end 124 of the pivotal member 12 is in the retaining position. The latch bar 23 of the latch hook unit 2 slides in the sliding grooves 212 to stretch the elastic members 24 during further pivotal movement of the second end 124 of the pivotal member 12 toward the door 51. Thus, the door 51 is tightly closed. Furthermore, the cushioning pad 26 abuts against the base 11 when the second end 124 of the pivotal member 12 is in the retaining position, preventing noise and damage resulting from impact between the body 21 and the base 11. The cushioning pad 26 does not abut against the base 11 when the second end 124 of the pivotal member 12 is not in the retaining position.

Figure 9:
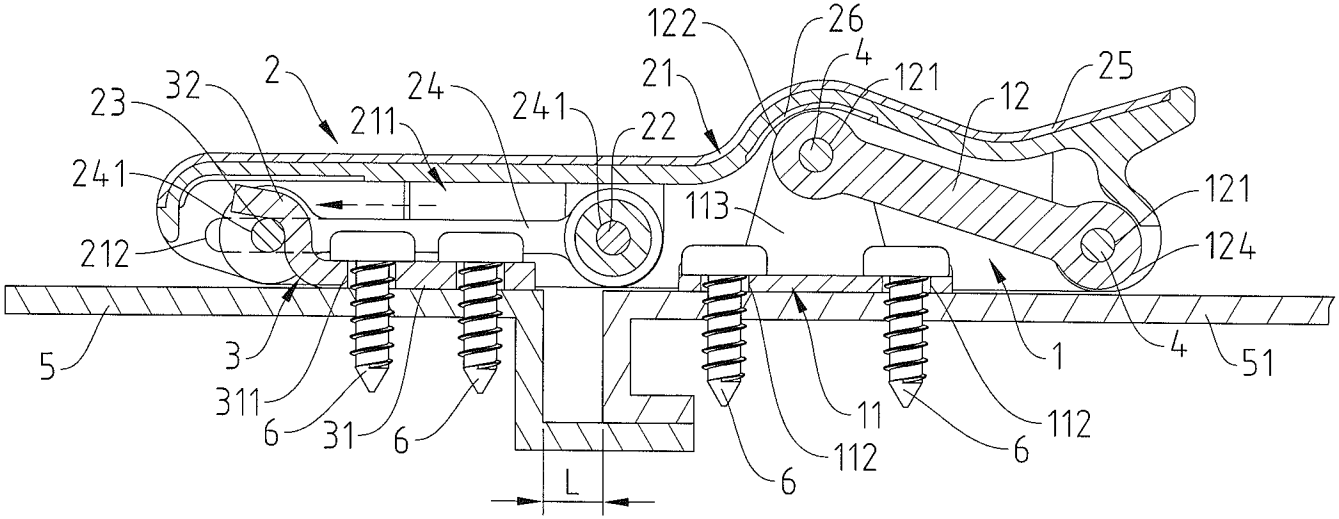
FIG. 9 is a cross sectional view illustrating use of the positioning device on a cabinet with a larger spacing between the door and a cabinet body.

With reference to FIG. 9, when a spacing L between the edge of the door 51 and the cabinet body of the cabinet 5 is larger, the latch bar 23 slides in the sliding grooves 212 to stretch the elastic members 24 to the desired extent, such that the door 51 can be tightly closed.

In view of the foregoing, the positioning device according to the present invention solves the disadvantages of the prior art and improves the function. Specifically, the elastic members 24 are attached between the positioning pin 22 and the latch bar 23. When the latch bar 23 engages with the hook portion 32, the latch bar 23 is slideable in the sliding grooves 212 to stretch the elastic members 24. When the second end 124 of the pivotal member 12 is in the retaining position in which the body 21 is also positioned, the returning force of the elastic members 24 pulls the latch bar 23 to tightly close the door 51 to the cabinet body of the cabinet 5. Furthermore, due to the elastic displacement capability provided to the latch bar 23 by the elastic members 24, a larger tolerance is provided during installation of the base 11 and the positioning member 3. Thus, the installation is easier.

Although specific embodiments have been illustrated and described, numerous modifications and variations are still possible without departing from the scope of the invention. The scope of the invention is limited by the accompanying claims.

The invention claimed is:

1. A latch hook positioning device comprising:

a base unit including a base and a pivotal member, with the pivotal member including a first end pivotably connected to the base and a second end, with the base adapted to be fixed to a first part of an article;

a latch hook unit including a body, a positioning pin, a latch bar, and a plurality of elastic members, with the body including a bottom side having a receiving space, with the body further including two sliding grooves respectively defined in two lateral walls at an end of the receiving space, with the two lateral walls spaced from each other in a width direction, with the second end of the pivotal member pivotably connected to another end of the receiving space of the body by a pivot, with the positioning pin fixed between the two lateral walls of the receiving space, with the latch bar including two ends respectively and slideably received in the two sliding grooves, with the latch bar and the positioning pin extending in the width direction, with the positioning pin located between the pivot and the latch bar, and with each of the plurality of elastic members including two ends respectively attached to the positioning pin and the latch bar; and a positioning member including a positioning portion and a hook portion extending from a side of the positioning portion, with the positioning member adapted to be fixed to a second part of the article, with the first part of the article pivotably connected to the second part of the article and movable between a closed position and an open position when the latch bar of the latch hook unit is disengaged from the hook portion of the positioning member, wherein when the first part of the article is in the closed position, the pivotal member is pivotable relative to the base, and the body of the latch hook unit is pivotable relative to the pivotal member, such that the latch bar of the latch hook unit is releasably engageable with the hook portion of the positioning member, wherein when the latch bar of the latch hook unit directly engages with the hook portion of the positioning member, the body of the latch hook unit and the pivotal member are further pivotable relative to the base, causing further pivotal movement of the second end of the pivotal member toward the first part of the article, wherein the second end of the pivotal member is positionable in a retaining position in which the second end of the pivotal member is located on a side of the base remote to the positioning member, wherein the first part of the article is securely retained in the closed position when the second end of the pivotal member is in the retaining position, and wherein the latch bar of the latch hook unit slides in the two sliding grooves and directly stretches the plurality of elastic members during further pivotal movement of the second end of the pivotal member toward the first part of the article.

2. The latch hook positioning device as claimed in claim 1, with the latch hook unit further including a cushioning pad mounted to a bottom wall of the receiving space of the body, with the cushioning pad abutting against the base when the second end of the pivotal member is in the retaining position, and with the cushioning pad not abutting against the base when the second end of the pivotal member is not in the retaining position.

* * * * *